US009816238B2

(12) United States Patent
Cochrane

(10) Patent No.: US 9,816,238 B2
(45) Date of Patent: Nov. 14, 2017

(54) BARRIER

(71) Applicant: COCHRANE STEEL PRODUCTS (PTY) LTD, Spartan, Kempton Park (ZA)

(72) Inventor: Alexander Richard Cochrane, Kempton Park (ZA)

(73) Assignee: COCHRANE STEEL PRODUCTS (PTY) LTD, Kempton Park (ZA)

( * ) Notice: Subject to any disclaimer, the term of this patent is extended or adjusted under 35 U.S.C. 154(b) by 0 days.

(21) Appl. No.: 14/664,050

(22) Filed: Mar. 20, 2015

(65) Prior Publication Data

US 2015/0292170 A1 Oct. 15, 2015

(30) Foreign Application Priority Data

Mar. 20, 2014 (ZA) ..... 2014/02032
Mar. 20, 2014 (ZA) ..... 2014/02033

(51) Int. Cl.

*E01F 15/00* (2006.01)
*E01F 13/02* (2006.01)
*E01F 15/08* (2006.01)
*E01D 19/10* (2006.01)

(52) U.S. Cl.

CPC ..... *E01F 13/022* (2013.01); *E01F 15/083* (2013.01); *E01D 19/103* (2013.01)

(58) Field of Classification Search

CPC ..... E01F 15/08; E01F 15/083; E01F 15/14; E01F 13/022; E01D 19/103; E04H 17/063; F41H 11/08

USPC ..... 256/13.1, 24, 65.14, 2, 32; 405/6, 9

See application file for complete search history.

(56) References Cited

U.S. PATENT DOCUMENTS 502,512 A * 8/1893 Ellwood ..... A01M 1/04 245/7
2,686,041 A * 8/1954 Cole ..... A01K 3/002 256/18
2,805,046 A * 9/1957 Petterson ..... E04H 4/06 256/25
4,111,399 A * 9/1978 Hutchison, III ..... E04H 17/04 245/8
4,318,079 A * 3/1982 Dickinson ..... E01F 13/123 116/52
4,515,349 A * 5/1985 Groves ..... E04H 17/063 256/1
4,685,656 A * 8/1987 Lee ..... E01F 15/025 256/13.1
4,690,382 A * 9/1987 Koperdak ..... E04H 17/063 256/1
4,903,947 A * 2/1990 Groves ..... E04H 17/063 256/1
4,971,319 A * 11/1990 Cutrone ..... A63B 47/025 473/432
5,039,065 A * 8/1991 Denton ..... E04H 17/063 256/1
5,186,438 A * 2/1993 Cross ..... E01F 7/04 256/12.5

(Continued)

*Primary Examiner* — Abigail Troy
*Assistant Examiner* — Nahid Amiri
(74) *Attorney, Agent, or Firm* — Young & Thompson

(57) ABSTRACT

A roadside barrier which has underlying concrete support blocks, a mesh fence, optionally including overlying transparent sheet material, which is erected on the blocks, and a deterrent, sloping mesh-material, surface, which hinders human access, at a base of the fence on the support blocks.

4 Claims, 9 Drawing Sheets

(56) References Cited

U.S. PATENT DOCUMENTS

| | | | | | |
|---|---|---|---|---|---|
| 5,402,988 | A * | 4/1995 | Eisele | E01F 13/022 | 160/351 |
| 5,407,178 | A * | 4/1995 | Long | A63B 71/022 | 160/354 |
| 5,615,866 | A * | 4/1997 | Kinnison | E04H 17/063 | 256/1 |
| 6,561,491 | B2 * | 5/2003 | Thompson | E04H 17/063 | 256/1 |
| 6,896,437 | B2 * | 5/2005 | Morgan | E04H 17/1421 | 135/909 |
| 7,104,720 | B2 * | 9/2006 | Humphries | E01F 8/0017 | 256/13.1 |
| 7,220,077 | B2 * | 5/2007 | Humphries | E01F 15/083 | 404/6 |
| 7,308,776 | B2 * | 12/2007 | Ray | E02D 27/42 | 52/155 |
| 7,628,385 | B2 * | 12/2009 | Laird | E04H 17/063 | 256/1 |
| D613,877 | S * | 4/2010 | Preston | A01M 1/04 | D25/45 |
| 7,887,027 | B2 * | 2/2011 | Garceau | E04H 17/066 | 24/336 |
| 8,613,130 | B2 * | 12/2013 | Larsen | E04H 17/161 | 256/21 |

* cited by examiner

FIGURE 7A
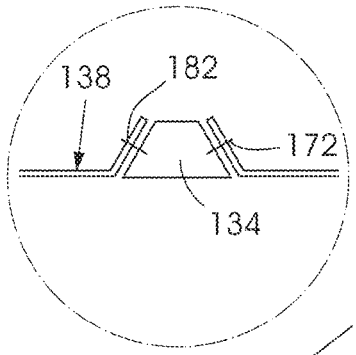
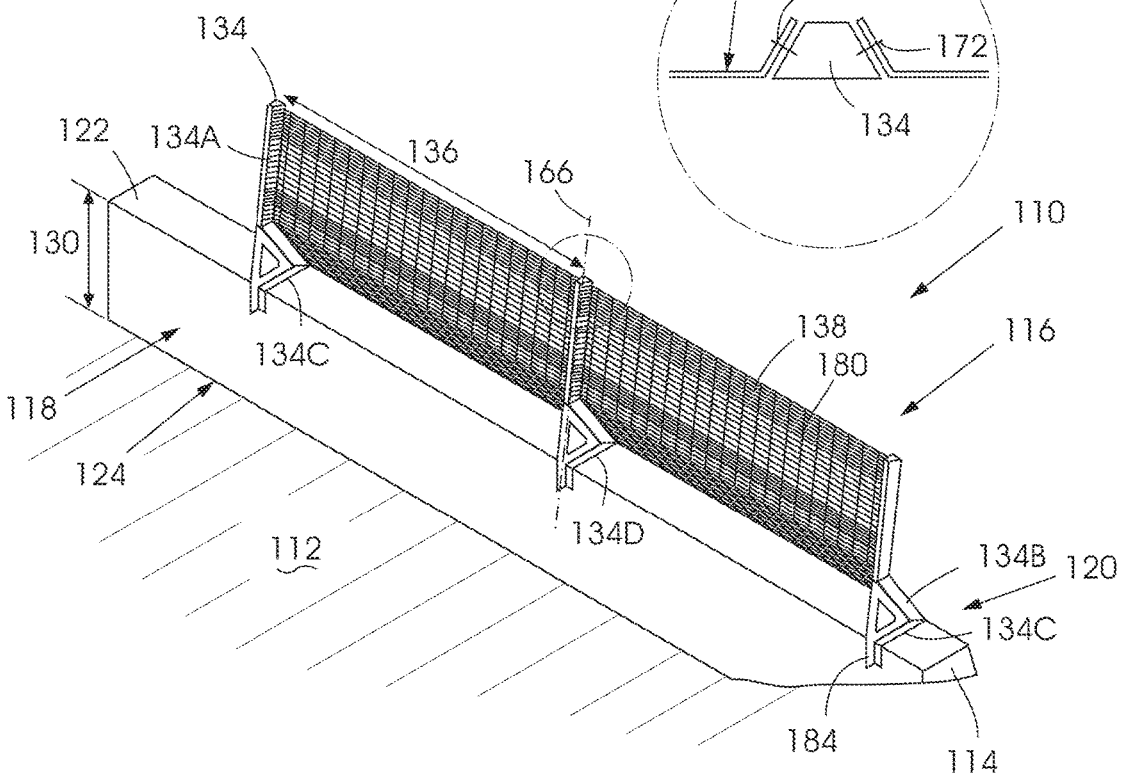
FIGURE 7

BARRIER

BACKGROUND OF THE INVENTION

This invention relates to a barrier.

The invention finds particular application in the provision of the barrier adjacent a road or a traffic lane or on a side of a bridge. These applications are however exemplary only and are non-limiting.

A bridge which is high and which spans a considerable distance can represent a substantial engineering feat. A bridge of this kind, for example crossing water which separates populated islands, or an island from a mainland, or which traverses dramatic mountain scenery, can attract considerable attention. Persons crossing the bridge on foot or in vehicles inevitably want to take advantage of the view afforded by being on the bridge. This type of visual capability should not however be at the expense of personal safety and, more particularly, it should not be easily possible for a person on the bridge to cross over a side of the bridge and intentionally or negligently put himself in a position of danger. For this reason the use of a barrier along at least one side of the bridge is desirable, if not essential.

Appropriate barriers are also used to demarcate a roadway. For example, concrete blocks are commonly used to separate traffic flow in one direction from traffic flow in an opposing direction. Similar blocks are also used, primarily for safety reason, to prevent or restrict pedestrians from crossing highways or freeways.

One type of structure which is at least partly suitable for the aforementioned purposes is formed from a number of precast concrete blocks, referred to as "New Jersey blocks", which are manufactured off-site and which are thereafter positioned on a roadway according to requirement e.g. on one side of a bridge or between or alongside traffic lanes. The blocks are substantial and generally can withstand the impact of a motor vehicle. However the blocks are not particularly high and cannot effectively prevent a pedestrian from climbing over the blocks to gain access to a traffic lane.

If a fence is erected on top of a structure of the aforementioned kind then, despite the impeding effect of the fence, a determined person can, by standing on top of the structure, get a secure foothold to climb over the fence.

An object of the present invention is to address, at least to some extent, the aforementioned situations.

SUMMARY OF THE INVENTION

The invention provides a barrier which comprises underlying support structure and a fence, wherein the fence includes a plurality of spaced apart, generally vertically extending, posts, each post including an elongate body with a respective lower end which is engaged with the support structure and an upper end, a plurality of mesh panels, each mesh panel comprising mesh structure with opposed first and second vertical edges and opposed upper and lower horizontal edges, each panel being located between a respective adjacent pair of posts with the first and second vertical edges respectively secured to the posts, and a deterrent arrangement, at least on one side of the panels, adjacent the lower horizontal edges of the panels, which restricts access to the panels.

A respective deterrent arrangement may be positioned on each side of the panels.

The deterrent arrangement may be of any suitable kind which can restrict access to the panels. Generally the deterrent arrangement, apart from restricting access, should make it difficult for a person to climb over a mesh panel.

In one form of the invention the deterrent arrangement includes a plurality of upwardly extending spikes. The underlying support structure may include an upper surface and the spikes may be fixed to such upper surface but spaced from the lower horizontal edges of the panels so that a person, approaching the panels, cannot with ease stand on the upper surface adjacent the panels.

In a different form of the invention the deterrent arrangement includes sheet-like material which is inclined to the vertical and which is positioned adjacent a respective lower region of each panel. The sheet-like material may comprise mesh sections, typically in planar form. Each section may be positioned adjacent a lower horizontal edge of a panel and may be inclined to the vertical. Each section may extend downwardly and away from the respective lower horizontal edge of the panel.

These mesh sections are preferably fixed to the underlying support structure.

The support structure may comprise an elongate cementitious ground-engaging body with such upper surface.

The cementitious body may be of any appropriate kind and for example may comprise precast concrete blocks e.g. of the New Jersey type, a concrete slab constructed for the purpose or a wall made, for example, in a conventional way from brick and mortar. In this respect "cementitious" is to be given a wide meaning.

In one form of the invention the mesh structure of a fence panel includes a first mesh section with a first mesh density and a second mesh section with a second mesh density, and sheet material is fixed to the mesh structure and overlies at least part of the second mesh section.

The second mesh density may be less than the first mesh density and, preferably, the size of each aperture in the second mesh section is greater than the size of each aperture in the first mesh section.

The sheet material is preferably continuous i.e. it is solid and does not have apertures. The sheet material may be transparent so that it does not meaningfully obstruct visibility. The sheet material may be positioned, relative to the ground, at a convenient height so that a person near the fence will be able to see through the sheet material.

If the second mesh section has a relatively large aperture size, the second mesh section may be relatively weak compared to the first mesh section. The addition of the sheet material to the second mesh section can strengthen the second mesh section.

At least part of the first mesh section may lie in a plane which is inclined to the vertical i.e. to a plane which is occupied at least by the second mesh section. Such inclined part of the first mesh section then acts as said deterrent arrangement.

In one form of the invention each post is shaped to engage with a side, and with the upper surface, of the support structure.

BRIEF DESCRIPTION OF THE DRAWINGS

The invention is further described by way of examples with reference to the accompanying drawings in which:

FIG. 7 is a view in perspective of part of a barrier according to another form of the invention;

FIG. 7A is a view of a post between adjacent flanges;

DESCRIPTION OF PREFERRED EMBODIMENTS

Figure 1:
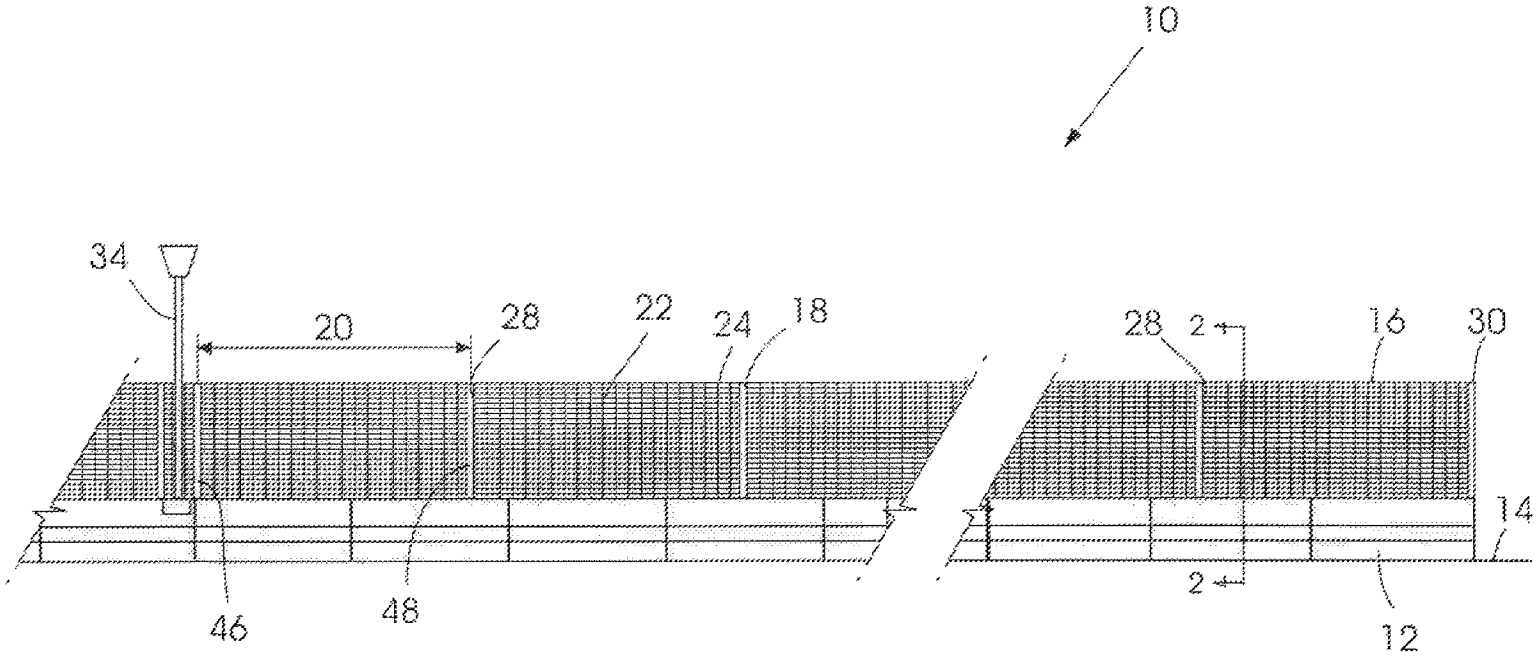
FIG. 1 is a side view of a barrier according to one form of the invention.

FIG. 1 of the accompanying drawings illustrates from one side a portion of an elongate barrier 10 according to one form of the invention. The barrier 10 includes underlying structure 11 comprising a plurality of precast cementitious blocks 12 which are positioned adjacent one another, following a defined path, on a roadway 14. Typically the blocks 12 are of the kind known as New Jersey blocks and they extend on a side of a highway, or on a highway to separate traffic flow in one direction from traffic flow in an opposing direction.

The barrier 10 further includes a fence 16 which is erected on top of the blocks 12. The fence is formed from a plurality of fence posts 18 which are spaced apart from each other, at regular intervals, by a distance 20. Mesh panels 22 are respectively located between and fixed to each adjacent pair of posts.

Each panel 22 comprising a respective rectangular mesh structure which is formed with appropriate mesh apertures and includes an upper horizontal edge 24, a lower horizontal edge 26, and opposed first and second vertical edges 28 and 30 respectively.

As appropriate, according to requirement, lamp posts 34 are fixed at intervals to the blocks.

Figure 2:
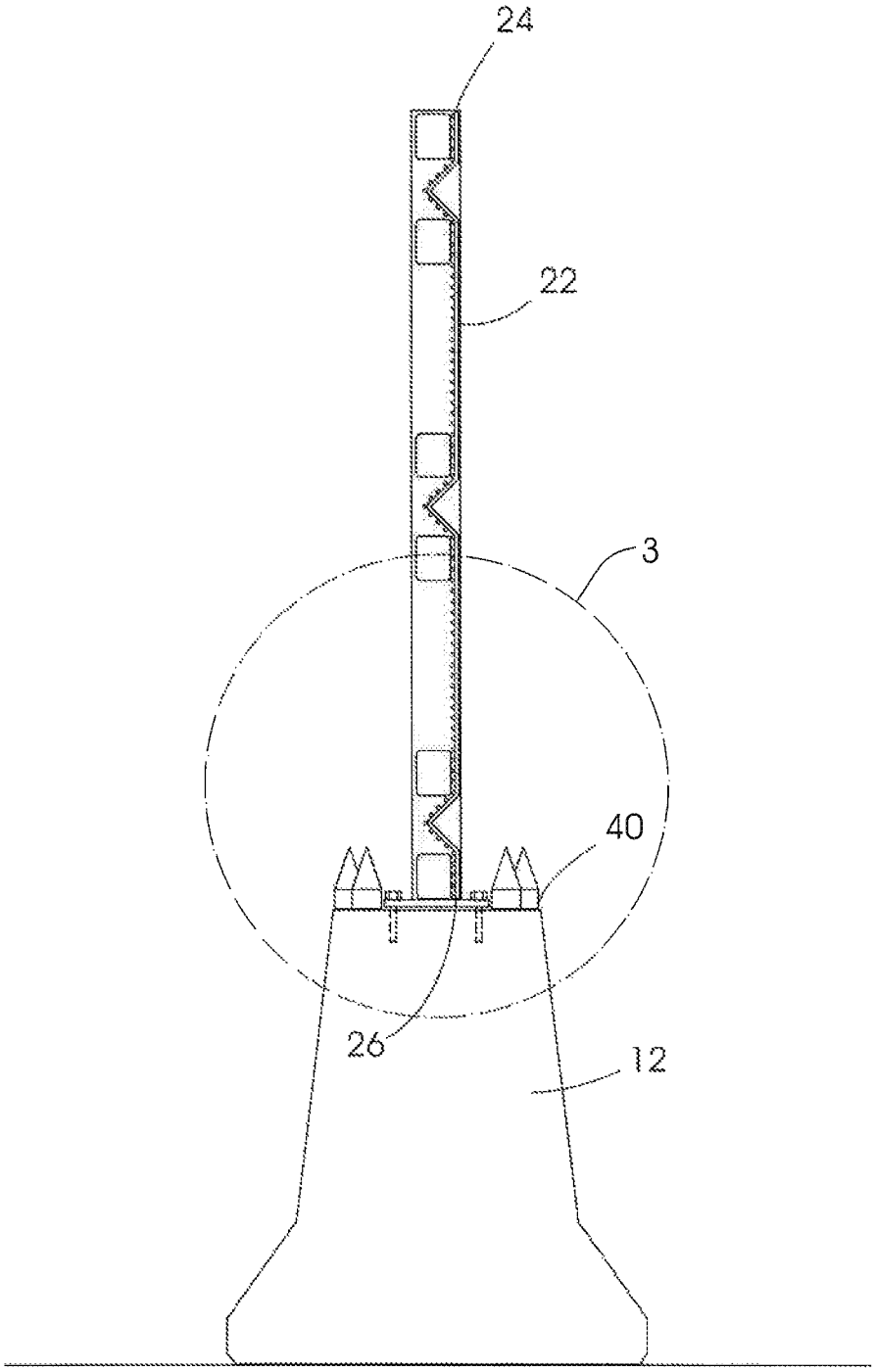
FIG. 2 is a cross-sectional view of the barrier taken on a line 2-2 in FIG. 1.
Figure 3:
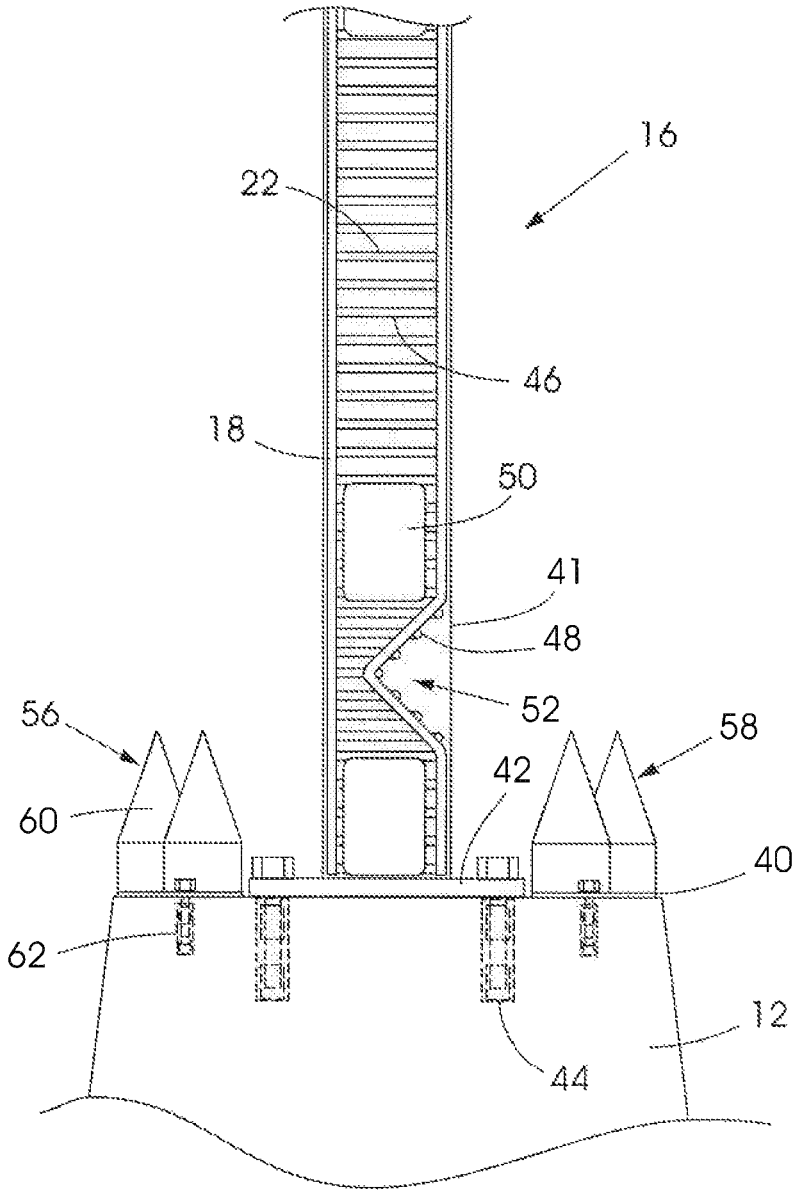
FIG. 3 is a view on an enlarged scale of a lower portion of the barrier which is enclosed in a circle marked 3 in FIG. 2.

FIG. 2 is a view in cross-section, on a slightly enlarged scale, of the barrier 10 taken on a line 2-2 in FIG. 1. FIG. 3 shows on an enlarged scale an intermediate portion, enclosed in a circle marked 3, of the construction in FIG. 2.

The blocks 12 form a flat upper surface 40 which facilitates erection of the fence 16. Each post 18 comprises an elongate member 41 to which is fixed a respective base plate 42 which, through the use of appropriate fasteners 44, is securely anchored to the upper surface 40.

The mesh panels 22 are substantially identical to one another. Each panel has respective flanges 46 and 48 at its vertical edges 28 and 30 respectively. FIG. 3 shows a flange 46 abutting a post 18. The flange is fixed to the post using suitable fasteners 50.

The panel 22 is stiffened in a horizontal direction i.e. against flexure about a vertical axis, by means of one or more reinforcing ribs 52 which extend horizontally. Each rib is defined by a V-shaped channel formed by bending the mesh under factory conditions. Similarly, the lower edge 26 is stiffened by means of a flange (not shown). The upper edge 22 is also stiffened by means of a flange which is similar to the flange.

The dimensions of the upper surface 40 are such that a person could stand on the upper surface and grip the adjacent mesh panel. The person could possibly thereby get sufficient support to climb over the panel. To obviate or to hinder this, in the FIG. 2 arrangement use is made of a deterrent arrangement 56 on one side of the fence and a substantially similar deterrent arrangement 58 on an opposing side of the fence. Each deterrent arrangement comprises a plurality of elongate spikes 60. The spikes are provided in strip form and each strip is fixed, generally parallel to the fence 16, to the upper surface 40 using fasteners 62. The spikes are sharp and a person trying to stand on top of the concrete blocks would find it uncomfortable or even dangerous and, in this way, the person would generally be deterred from trying to climb over the fence.

Figure 4:
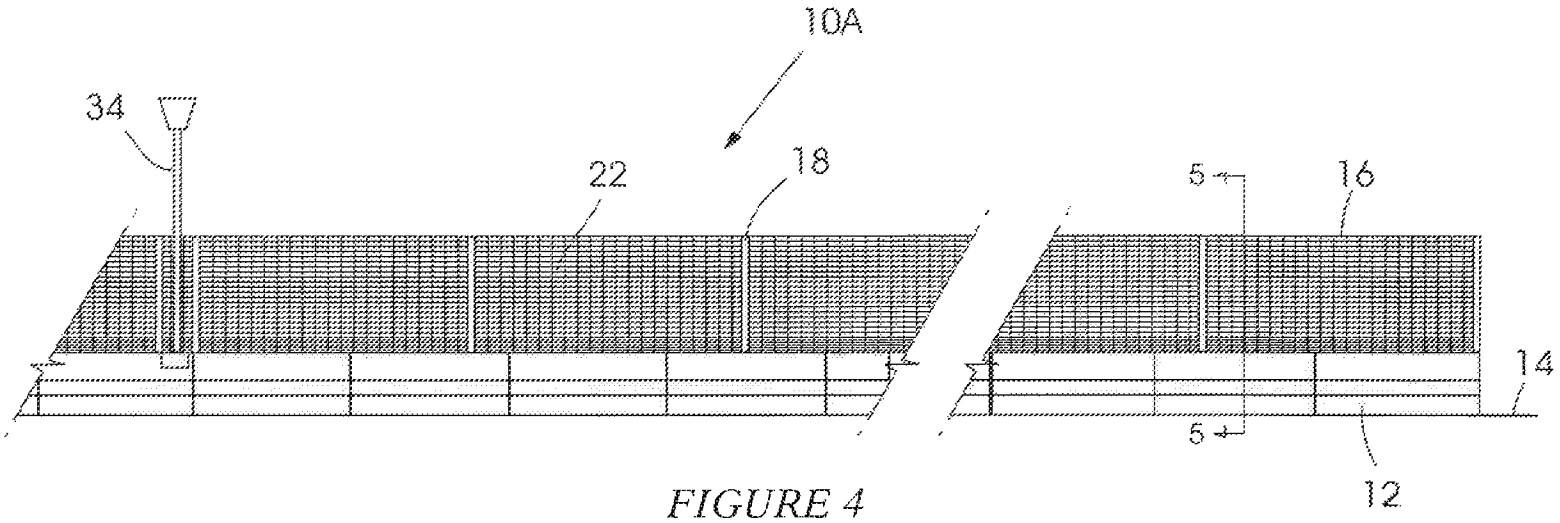
FIGS. 4, 5 and 6 are views respectively corresponding generally to FIGS. 1, 2 and 3 but illustrating a barrier according to a second form of the invention.
Figure 5:
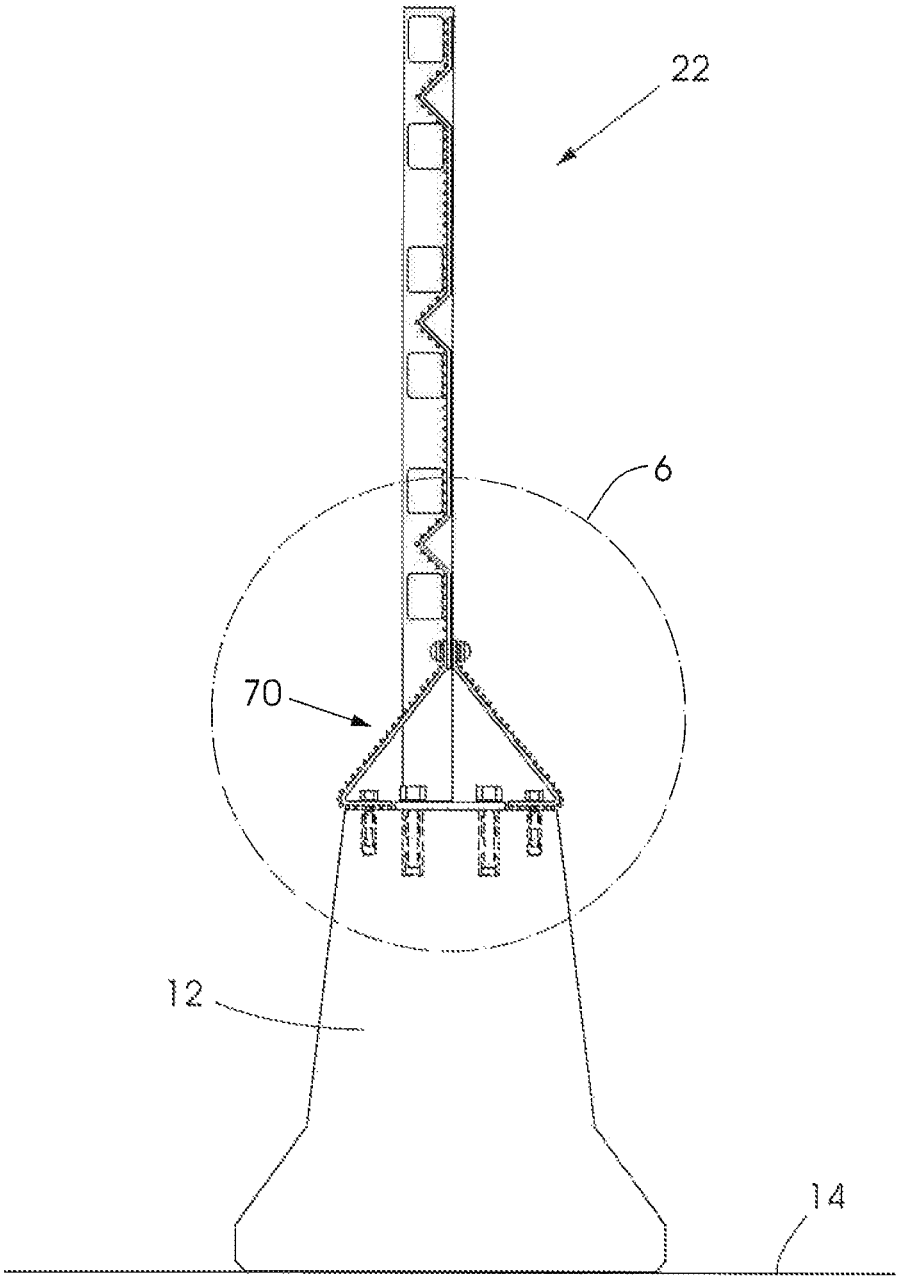
Figure 6:
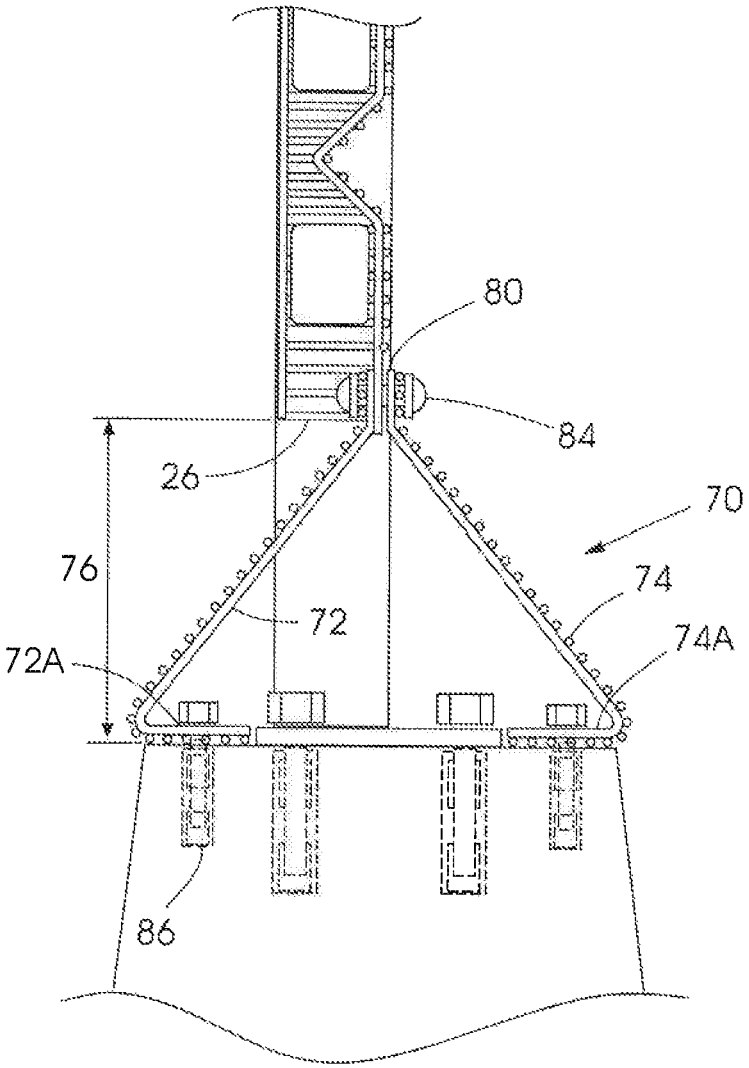

FIGS. 4, 5 and 6 are similar to FIGS. 1, 2 and 3 respectively and illustrate a barrier 10A according to a different form of the invention. There are substantial similarities between the barrier 10 and the barrier 10A and for this reason the barrier 10A is not described in detail. Where applicable like reference numerals are used to designate like components.

In the barrier 10A the deterrent strips of spikes (56, 58) are replaced by a deterrent arrangement 70 which is shown, more clearly, in FIG. 6. The deterrent arrangement 70 includes mesh sections 72 and 74, in sheet (planar) form which are generally identical but which are erected in opposing orientations.

Lower edges 26 of the mesh panels, which make up the fence 16, could rest on the flat upper surface 40 of the concrete blocks. Preferably though, to increase the height of the fence 16 without using additional material, the lower edges are spaced from the surface 40 by a distance 76. The mesh sections 72 and 74 are secured, at their upper edges 80, by means of suitable fasteners 84 to the mesh panels adjacent the lower edges 26. The sections 72 and 74 extend downwardly and outwardly to lower horizontal flange sections 72A and 74A respectively which are directly fixed, by means of appropriate fasteners 86, to the upper surface 40.

The mesh sections 72 and 74 have outwardly and downwardly extending surfaces which effectively cover the flat upper surface 40 of the concrete blocks. A person, who attempts to stand over the blocks in order to grip and then climb over a mesh panel, would find it difficult to stand on the sloping surface of a mesh section and, in this way, would generally be deterred from trying to climb over the mesh panel.

FIG. 7 illustrates in perspective portion of a barrier 110 according to another form of the invention.

Typically the barrier 110 is on one side of a roadway 112 which is formed on a bridge or similar elevated construction. Usually, if the bridge is a high rise bridge in an attractive or interesting area, a person on the roadway 112 would be afforded a good view of the surroundings. The barrier 110 is designed to act as a safety arrangement in that it makes it difficult for a person to leave the roadway or the bridge except at designated points, but without unduly interfering with the view which is available to a person on the bridge.

The barrier 110 includes underlying support structure 114 and a fence 116. The support structure is made from precast concrete blocks which are placed in situ, as required, or from concrete which is cast in situ. The support structure has an inner side 118, an outer side 120 and an upper surface 122. A lower end 124 of the support structure rests on the ground or is engaged therewith in any appropriate manner.

The support structure has a height 130. The dimensions and mass of the support structure are such that the structure is capable of resisting an impact which may arise from a vehicle traversing the roadway 112.

Figure 8:
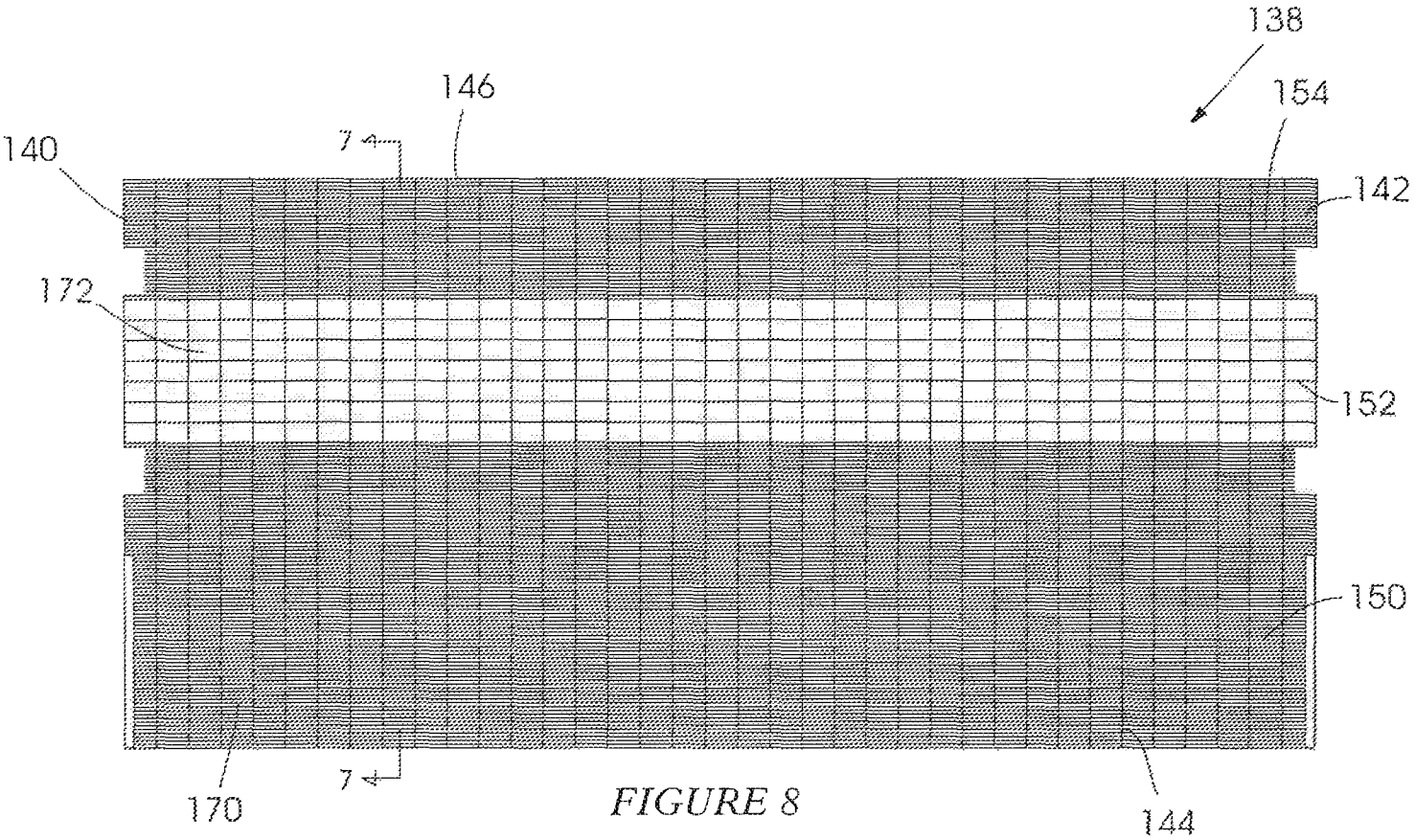
FIG. 8 is a side view on an enlarged scale, compared to the scale in FIG. 7, of a fence included in the barrier of FIG. 7.

The fence 110 includes a plurality of generally vertically extending fence posts 134 which are regularly spaced apart from one another by a distance 136. Secured to the fence posts are a number of mesh panels 138. The mesh panels are substantially identical to one another. Each mesh panel, see in addition FIG. 8, is made from a rectangular mesh structure which includes opposed first and second vertically extending edges 140 and 142 and opposed horizontally extending lower and upper edges 144 and 146 respectively.

Figure 9:
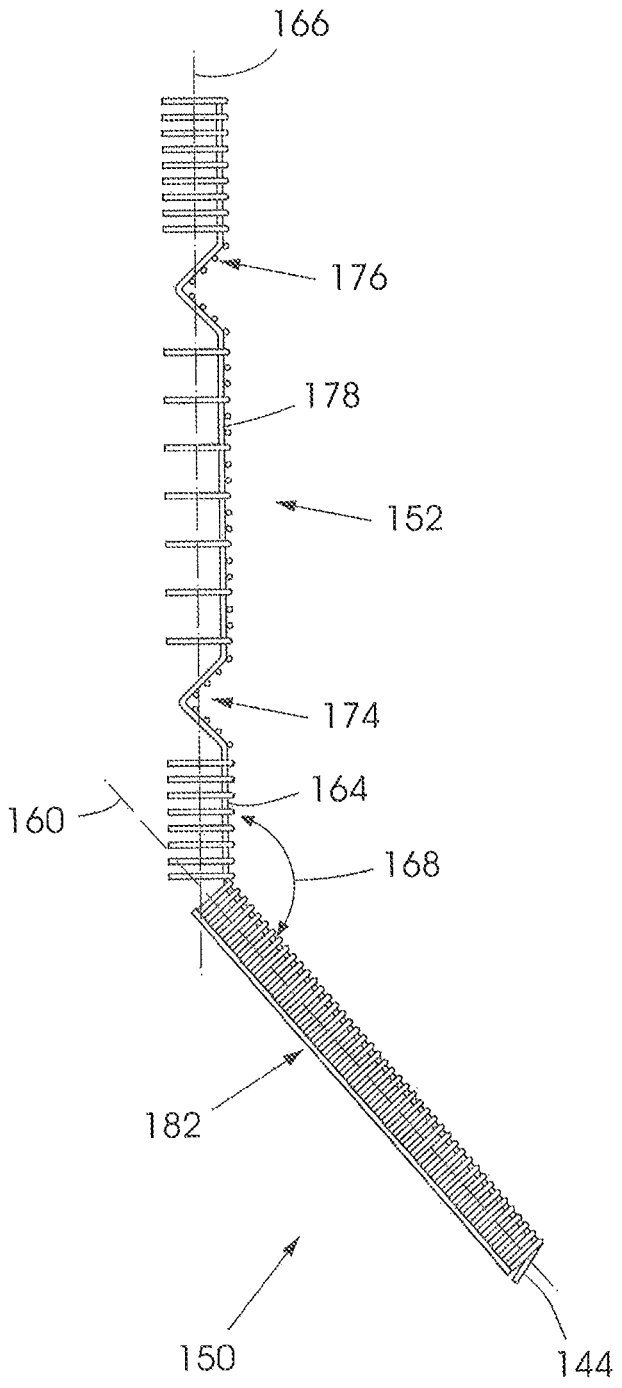
FIG. 9 is a view in cross-section taken on a line 9-9 in FIG. 8 of a mesh panel which is included in the fence.

The fence panel 138 includes a lower, first, mesh section 150, an intermediate, second, mesh section 152 and an upper, third, mesh section 154. Referring as well to FIG. 9, a lower portion of the first mesh section 150, which is bounded by the lower edge 144 of the panel, lies in a first plane 160. An upper part 164 of the first mesh section lies in a second plane 166 which is inclined at an angle 168 to the first plane. The second mesh section 152 and the third mesh section 154 lie in the plane 166. In use of the fence panel 138 the plane 166 is generally vertical and the plane 160 is inclined to the vertical.

The first mesh section 150 has a relatively high mesh density compared to the second mesh section 152 i.e. the sizes of its apertures 170 are relatively small compared to the size of each aperture 172 in the second mesh section. This means that the first mesh section is substantially stronger than the second mesh section. The third mesh section 154 is typically of the same mesh density as the first mesh section.

The second mesh section 152, see FIG. 9, is strengthened by means of horizontally extending reinforcing ribs 174 and 176 respectively which are formed by bending vertical wires of the mesh into a V-shape. These reinforcing ribs are respectively at a boundary of the second mesh section and the first mesh section, and at a boundary of the second mesh section and the third mesh section.

Sheet material 178 is attached to the second mesh section by means of suitable fasteners 180 which are only notionally shown in FIG. 7. The sheet material is typically solid i.e. without apertures, clear or transparent polycarbonate with an appropriate thickness. The polycarbonate material is tough and weather resistant and, when attached to the panel, substantially strengthens the second mesh section. The aperture size of the second mesh section is such that the wires in the section do not unduly interfere with visibility i.e. a see-through capability. The polycarbonate panel attached to the second mesh section ensures that the visibility factor is not adversely affected but the strength of the second mesh section is significantly enhanced.

The vertical edges 140 and 142 of the panel are formed with respective flanges 182—see FIG. 9 which illustrates one flange only. Each flange 182, when the panel 138 is positioned between adjacent fence posts 134 as shown in FIG. 7 abuts a respective post 134 and is attached to the fence post by means of appropriate fasteners 72 which pass through the flange and which are engaged with the post—see FIG. 7A which shows a post 134 between adjacent flanges 182.

Each post 134 is shaped in a complementary manner to the profile shown in FIG. 9. Thus each post has a vertical section 134A, a sloping section 134B, a section 134C which is designed to lie flat on the upper surface 122 of the support structure, and a relatively short section 134D which extends downwardly and which abuts the side 118 of the support structure. The section 134A lies in the plane 166 and the mesh sections 164, 152 and 154 are attached thereto. The section 134B lies in the plane 160 and the mesh section 150 is, in use, secured thereto. The sections 134C and 134B, which are at a right angle to each other, provide a means whereby the fence post can be securely and relatively easily attached to the support structure 114 in the manner shown in FIG. 7 through the use of appropriate fasteners 184.

The barrier 110 is of composite construction. The fence which is designed to fit securely and closely on top of the support structure, ensures that the effective height of the barrier 110 is increased substantially above the height 130. The increase in height means that it is difficult for a person, on the roadway, to climb over the barrier. On the other hand the transparent sheet material which is positioned in a horizontally extending band at an intermediate location of the fence stiffens the mesh over that portion thereof which is of reduced mesh density, but does not impede visibility.

The barrier 110 is suitable for use on a bridge or similar roadway. The barrier can however be used in other applications in order to create a controlled environment on one side of the barrier, without interfering with visibility through the barrier. Thus the barrier 110 could be positioned between two traffic lanes to allow a see-through capability.

The deterrent arrangement at the base of the fence makes it difficult for a person to climb over the fence. The deterrent arrangement, in each embodiment, could include spikes, or an inclined mesh section, or both, on one side or both sides of the fence, at its lower edge, adjacent the upper surface of the concrete support structure.

The invention claimed is:

1. A barrier comprising:

an underlying support structure which comprises an elongate cementitious ground-engaging body which has an upper surface and which comprises a plurality of cementitious blocks adapted to be positioned adjacent one another extending on, or on a side of, a highway, a fence which is erected on top of the blocks, wherein the fence includes i) a plurality of spaced apart, generally vertically extending, posts, each post including an elongate body with a respective lower end which is engaged with the support structure and an upper end, and ii) a plurality of mesh panels, each mesh panel comprising a rectangular mesh structure with opposed first and second vertical edges and opposed upper and lower horizontal edges, each mesh panel being located between a respective adjacent pair of first and second posts of said plurality of posts, with the first and second vertical edges of each mesh panel being respectively secured to the first and second posts, and a deterrent arrangement, at least on one side of the mesh panels, adjacent the lower horizontal edges of the mesh panels, the deterrent arrangement being provided on top of the concrete blocks and restricting access to the mesh panels, said deterrent arrangement comprising sheet material which is inclined to the vertical and which is positioned adjacent a respective lower region of each mesh panel with a lower section of the sheet material fixed to said cementitious body and with an upper section of the sheet material fixed to a lower region of each mesh panel, the deterrent arrangement presenting a sloping surface extending away from the lower region of the mesh panels towards the underlying concrete blocks.

2. A barrier according to claim 1, wherein each post is shaped to engage with a side surface, and said upper surface, of the cementitious body.

3. A barrier according to claim 1, wherein the lower end of each post is fixed to a respective base plate which is anchored to said upper surface.

4. A barrier according to claim 1, wherein said mesh structure is stiffened by one or more horizontally extending reinforcing ribs.

* * * * *